United States Patent [19]

McDonald

[11] 4,292,952

[45] Oct. 6, 1981

[54] FIREPLACE FURNACE

[76] Inventor: Charles B. McDonald, Rte. 1, Atkins, Ark. 72823

[21] Appl. No.: 67,016

[22] Filed: Aug. 16, 1979

[51] Int. Cl.[3] ..... F24B 7/00

[52] U.S. Cl. ..... 126/121; 126/120; 126/288; 126/285 R

[58] Field of Search ..... 126/120, 121, 131, 143, 126/61, 63, 66, 77, 85 B, 288, 290, 126, 132

[56] References Cited

U.S. PATENT DOCUMENTS

| | | | |
|---|---|---|---|
| 1,178,854 | 4/1916 | Keeler | 126/120 |
| 1,537,361 | 5/1925 | McGlamery | 126/120 |
| 2,877,834 | 3/1959 | Campbell | 431/202 |
| 4,006,729 | 2/1977 | Cesa | 126/293 |
| 4,026,263 | 5/1977 | Boyd | 126/135 |
| 4,108,144 | 8/1978 | Wilhoite | 126/120 |

FOREIGN PATENT DOCUMENTS

| | | | |
|---|---|---|---|
| 519692 | 4/1940 | United Kingdom | 126/120 |
| 872465 | 7/1961 | United Kingdom | 126/132 |

*Primary Examiner*—Samuel Scott
*Assistant Examiner*—Lee E. Barrett
*Attorney, Agent, or Firm*—Harvey B. Jacobson

[57] ABSTRACT

The fireplace furnace is constructed with two flues which merge into a single chimney. An upper flue is directly above the fire as is in ordinary fireplace and includes a first damper which can be moved between open and closed positions. A lower flue is near the bottom of the fireplace and contains a secondary damper. Glass or metal doors enclose the front of the fireplace furnace and the fire is built with the upper damper fully open. The glass doors are closed, the upper damper is closed and the lower damper is open. The fireplace then operates as a furnace and can be connected to duct work existing throughout the house. The use of the lower flue increases the radiation of heat and conserves fuel by forcing the heated products of combustion to remain within the burning chamber of the fireplace furnace for a greater length of time. One outside air intake is connected to each side of the fireplace furnace firebox. Dampers are provided in the outside air intakes and are operated through connecting shafts to a pair of dampers disposed in house heating ducts connected on each side of the furnace. The house duct work includes fans disposed on each side of the furnace and as more heat is required within the house, the house thermostat activates the fans which cause movement of the respective dampers within the duct work. The duct dampers in turn control the air intake dampers thus increasing the intensity of the fire.

9 Claims, 8 Drawing Figures

FIREPLACE FURNACE

BACKGROUND OF THE INVENTION

1. Field of the Invention

This invention relates to the field of home heating systems and especially to fireplace structures adapted for the purpose of providing a source of heat for the home.

2. Discussion of Related Art

The rapid increase in the cost of energy has caused many concerned people to search for alternate energy sources and alternate means of utilizing the presently available energy sources. Accordingly, renewed interest in fuel, such as wood, which was abandoned as a viable source of energy, has begun. Also, home fireplaces are taking on a new usefulness in providing heat to the home as well as providing an aesthetically pleasing diversion. Accordingly, there has been a renewed interest in fireplace structures to seek such a structures which can be used to efficiently consume wood or other combustible materials and transfer the heat of combustion to various points within the home for the purpose of heating the home while at the same time maintaining a pleasing look to the fireplace so as not to destroy its aesthetic appeal.

There are many known fireplace configurations which are designed for the purpose of efficiently providing heat to their surroundings. For instance, U.S. Pat. No. 4,061,189 issued Dec. 6, 1977 shows a heat exchange apparatus which can be used in a fireplace firebox. The heat apparatus includes a means for establishing a vortex pattern area to maintain a stable vortical flow of heat donative gas within the area and in proximity to heat exchange surfaces in order that the path of the donative gas and the time of residency of the donative gas are prolonged. U.S. Pat. No. 3,995,611, issued Dec. 7, 1976 to Nelson shows a fireplace heating channel which comprises a hollow metal air conveying channel in combination with a flame guide vein, insertable into an existing conventional fireplace. The channel has a central panel and at least one forward facing channel arm adapted to fit against multiple inside walls of a fireplace. U.S. Pat. No. 1,756,511, issued Apr. 19, 1930 to Dowler, shows a fireplace having a firebox section and a smoke dome section. A depending lip is formed along the lower front edge of the smoke dome section adapted to be received within a U-flange interlock casing and the smoke dome section in assembled position. A damper is positioned in the firebox and can be rotated between the depending position, a closed position, and an upwardly extendly position. U.S. Pat. No. 4,004,731, issued Jan. 25, 1977 to Zong, shows a device for transferring heat energy from a fireplace to a fluid heating system. The Zong device includes an independent air supply means to provide air from the building exterior to the fireplace chamber and includes a damper disposed in the independent air supply means to regulate the flow of air therethrough.

SUMMARY OF THE INVENTION

On object of the present invention is to provide a fireplace furnace which can act either as a standard home fireplace designed to provide purely aesthetic appeal or as a source of high intensity heat for heating the surrounding structure.

A further object of the present invention is to provide a fireplace furnace which can be incorporated in a central heating system of a structure and can be regulated easily in accordance with the demand for heat within the structure.

An even still further object of the present invention is to provide a fireplace furnace which will produce large amounts of heat for a structure yet is relatively simple in construction and inexpensive to manufacture.

In accordance with the above objects, the fireplace furnace of the present invention includes a firebox having a main, upper flue section with a damper disposed therein. With the main flue damper open, the fire in the firebox can be ignited and the fire will burn as in an ordinary fireplace. A secondary flue opens at a position spaced below the main flue and includes a secondary damper for opening or closing the secondary flue. With the main flue damper closed and the secondary flue damper open, the front of the fireplace can be closed off as with glass doors and the heat therein will build up a higher temperature due to the lower opening of the secondary flue which causes a more intense buildup of heat within the firebox prior to the products of combustion being exhausted through the secondary flue. Ducts connect each side of the firebox to a source of external air and an air intake damper is disposed in each duct. Air circulation ducts can also be attached to each side of the fireplace furnace and communicate with an exchange area surrounding the firebox. A fan is disposed in each air circulation duct and is turned on in response to a thermostat in the house. A damper is disposed across each air circulation duct and is deflected in response to actuation of the respective air circulation fan. A rod connects the damper in one air circulation duct with the damper in one air intake duct and causes displacement of the damper in the air intake duct also in response to actuation of the fan. Accordingly, when heat is demanded within the structure, the damper in the air intake duct is opened, thereby allowing the fire to increase in intensity.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
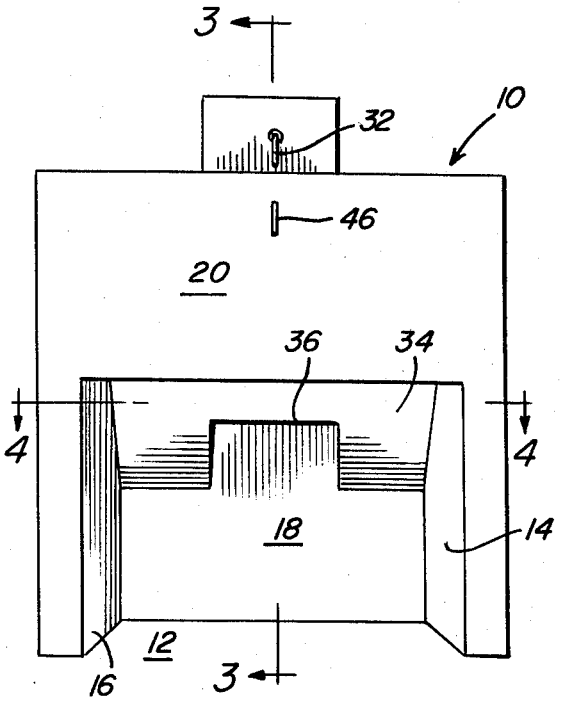
FIG. 1 shows a front elevational view of the fireplace furnace.
Figure 2:
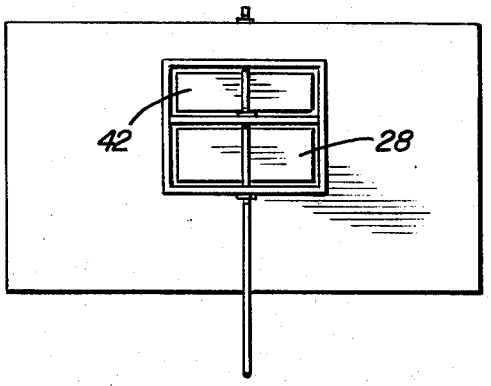
FIG. 2 is a top plan view of the fireplace furnace.
Figure 3:
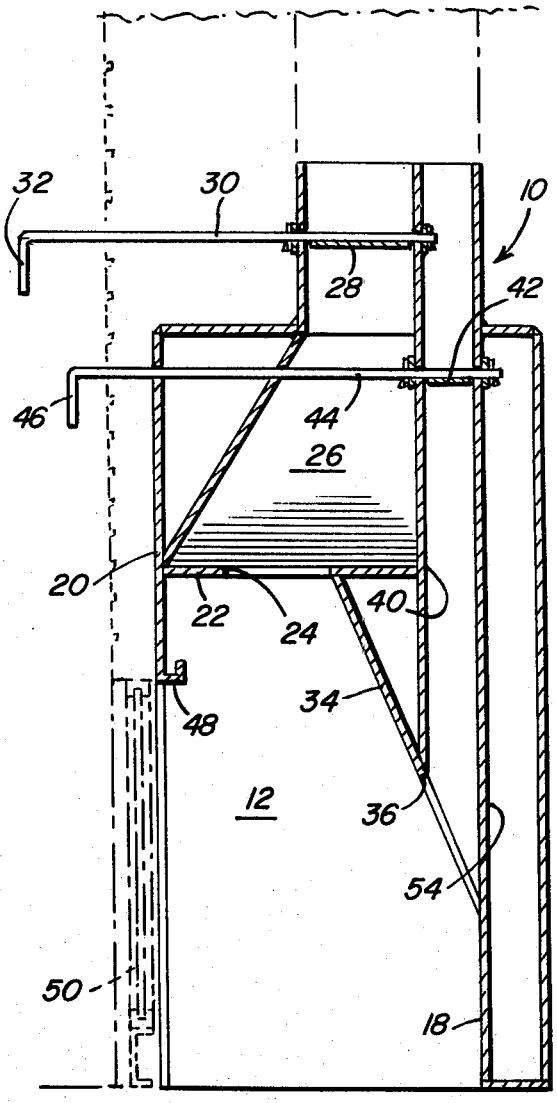
FIG. 3 is a side elevational sectional view taken substantially alone a plane passing through section line 3—3 of FIG. 1.
Figure 4:
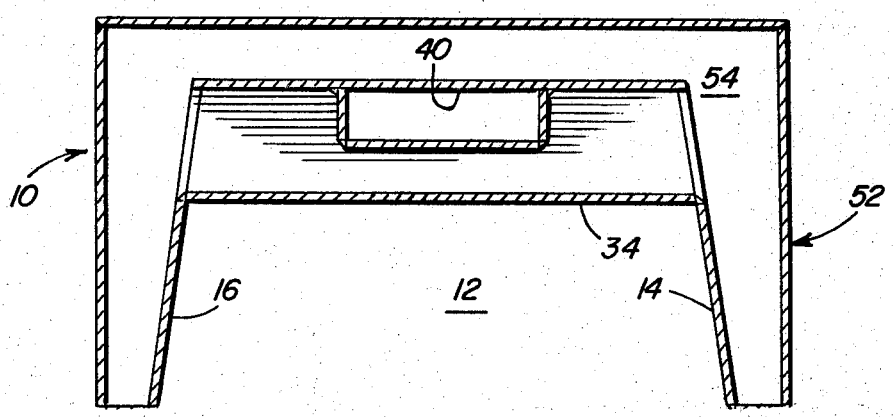
FIG. 4 is a top plan sectional view taken substantially along a plane passing through section line 4—4 of FIG. 1.

Now with reference to the drawings, a fireplace furnace incorporating the principles and concepts of the present invention and generally referred to by the reference numeral 10 will be described in detail. With specific reference to FIGS. 1—4, it will be seen that the fireplace furnace 10 includes a firebox 12 which has side vertical walls 14 and 16 and a rear wall 18. A front vertical wall 20 extends downwardly covering a portion of the firebox and is attached to top horizontal wall 22. Top wall 22 contains an aperture 24 which opens into the upper, main flue 26. Disposed across the main flue 26 is a primary damper 28 which consists of a plate mounted on shaft 30 for rotation therewith. Shaft 30 is supported and journaled in the flue walls and extends forwardly of the fireplace ending in handle portion 32 which is accessible for opening or closing the damper 28. With damper 28 open, the fireplace furnace 10 acts in a manner similar to that of any ordinary fireplace.

A final firebox wall is shown at 34 and slants rearwardly from the upper wall 22 to the rear wall 18. An aperture 36 is formed in wall 34 and communicates the interior of a firebox with a secondary flue 40. A secondary damper 42 is contained in flue 40. A secondary damper 42 is contained in flue 40 and consists of a plate mounted on shaft 44 which is operated by handle 46. Clearly, aperture 36 is located in the firebox well below aperture 24. Accordingly, any heat rising from a fire built in the firebox 12 will tend to rise vertically and exit through the flue 26. However, if damper 28 is in its closed position, the products of combustion will tend to circulate about the interior of the firebox and flue 26 and will be forced downwardly to enter the secondary flue 40 at which time they will exit through flue 40 if damper 42 is open. In this mode operation, the fireplace furnace acts in a manner similar to a furnace and the efficiency of operation is greatly enhanced. Of course, in the furnace mode of operation, opening 48 in wall 20 must be closed off in order to insure that products of combustion will not be allowed to exit into the interior of the room. For this purpose, an enclosure such as a sealed glass door shown in phantom at 50 can be installed and used to cover opening 48. Of course, door 50 could also be made from metal or any other suitable material.

In operation, with doors 50 open, wood can be placed in the firebox 12 and the damper 28 opened. The wood would then be lit and allowed to reach a normal rate of combustion with the damper 28 open and the heated gases from the fire exiting through main flue 26. After the fire is burning the doors 50 would be closed and damper 28 would be closed also, forcing the hot gases to exit through the secondary flue 40. This increases the heat transferred through the walls of the firebox. An outer shell shown generally at 52 surrounds the firebox and defines a heat exchange area 54 between the firebox and the shell enclosing a major portion of the firebox therein. This heat exchange area can be used in any known manner as, for example, by connection to the central heating ducts of the structure in order to heat the air passing through the ducts.

Figure 5:
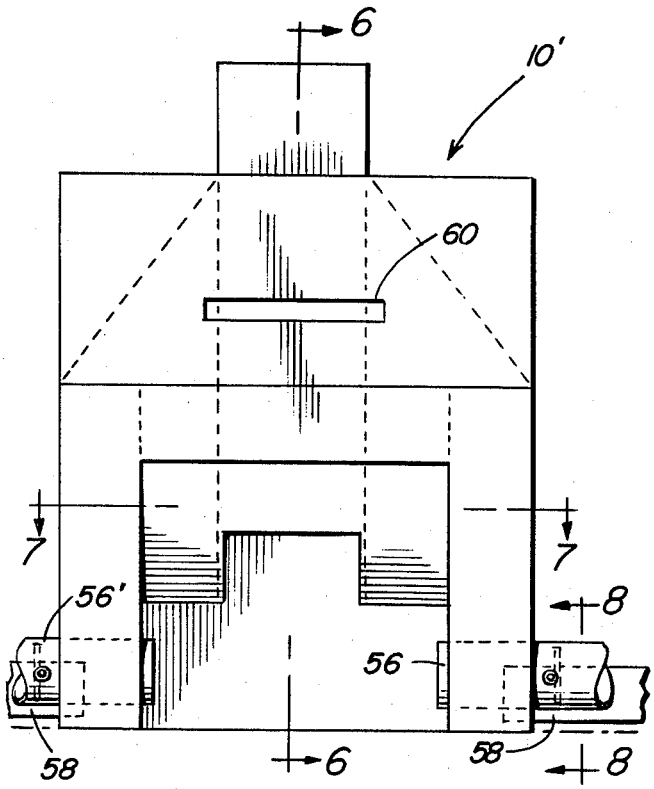
FIG. 5 is a front elevational view showing a fireplace furnace of the present invention incorporating a blower fan.
Figure 6:
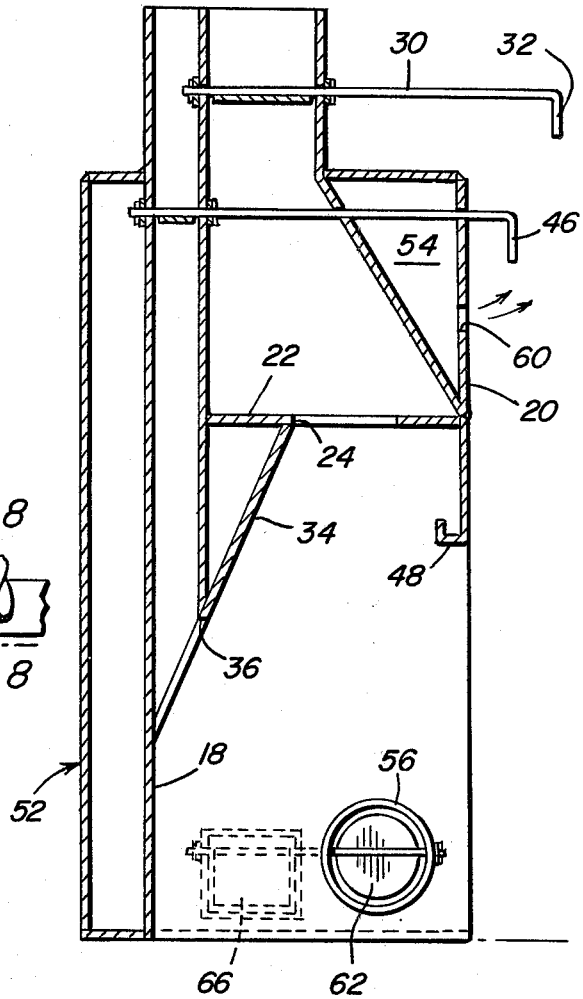
FIG. 6 is a side elevational sectional view taken substantially along a plane passing through section line 6—6 of FIG. 5.
Figure 8:
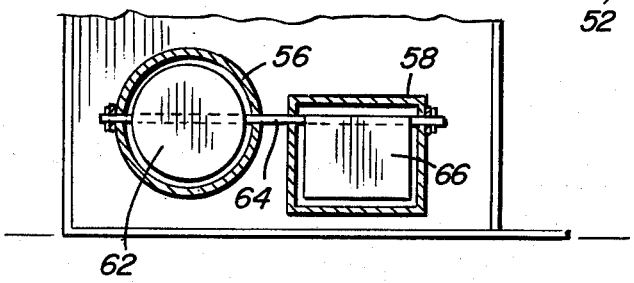
FIG. 8 is a side elevational sectional view taken substantially along a plane passing through section line 8—8 of FIG. 5.
Figure 7:
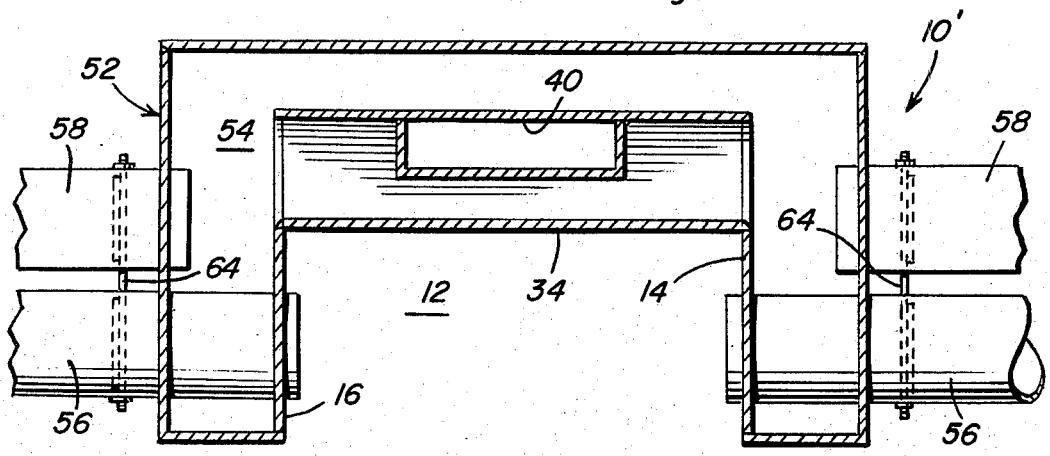
FIG. 7 is a top plan sectional view taken substantially along a plane passing through section line 7—7 of FIG. 5.

However, with reference to FIGS. 5–8, it can be seen that a preferred mode of operation provides a self-contained air circulation and heat control apparatus with the fireplace furnace. The embodiment of the fireplace furnace shown in FIGS. 5–8 is designated 10' and contains the same elements denoted by like numerals as those of FIGS. 1–4. In addition, disposed in the outer shell 52 and extending through into each side of the firebox 12 is a separate air intake duct 56 which extends from a position exterior of the building to supply fresh air to the firebox. Running alongside of each duct 56 is an in-house duct 58 which has an inlet positioned conveniently within the house for transmitting air to the heat exchange area 54 which surrounds the firebox. An opening 60 in the upper portion of wall 20 above the firebox allows the heated in-house air to exit into the room surrounding the fireplace.

In order to control and regulate the amount of heat generated by the fireplace furnace so that the efficiency of the fireplace furnace will be advantageously increased, a damper flap 62 is disposed in each air intake duct 56 and mounted to a shaft 64 which extends between each air intake duct 56 and its paired in-house duct 58. It will be noted that each damper 62 is circular in shape and is mounted through its diameter on the associated shaft. An in-house damper 66 is mounted in each in-house air duct and is also attached to a shaft 64. It will be noted that each damper 66 depends from its respective shaft 64 in order that it will be deflected by any air passing through the associated house air duct. A fan (not shown) is connected to each duct 58 between the inlet of that duct and the associated damper 66. A thermostat contained within the house is used to control the fan operation and will be started when the temperature in the house falls below that set on the thermostat. At this time, the air passing through ducts 58 will deflect dampers 56. This in turn causes rotation of rods 64 and displaces the dampers 62 to allow a greater amount of combustion air to enter the firebox through ducts 56. The intensity of the fire within the firebox is thus increased and more heat is generated until the thermostat signals that the temperature within the house is adequate. Of course, at this time, the fan is stopped and airflow through ducts 56 decreases causing a return of dampers 62 to their original position and the fire in the firebox once again dies to its original level.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fireplace structure for use in heating a building environment, said fireplace structure comprising:

a firebox having enclosing opposite side walls, a rear wall and a top wall;

a first flue having an opening in said top wall and extending upwardly from said opening for removing products of combustion from said firebox;

a first damper disposed across said first flue for selectively closing said first flue; and a second flue having an opening disposed below the opening of said first flue, said second flue extending upwardly from its respective opening, including jacket means defining a heat exchange area around said firebox for heating air passed therethrough, an air intake duct having an intake end positioned exteriorly of said building and an outlet end positioned in said firebox for channeling combustion supporting air to said firebox, a damper disposed in said air intake duct; a building air circulation duct opening into said heat exchange area and having an intake end opening into said building for circulating building air through said heat exchange area, and an outlet port in said heat exchange area for reintroducing building air into said building interior, said building air circulation duct including a damper flap disposed therein, said damper flap and said air intake duct damper being connected to a common shaft, said damper flap being positioned across said air circulation duct so as to be displaced by air movement therethrough, thereby causing displacement of said damper in said air intake duct.

2. The fireplace structure defined in claim 1 wherein said damper flap is attached in a depending position from said common shaft.

3. The fireplace structure defined in claim 2 and further including a fan means connected to said air circulation duct.

4. The fireplace structure for use in heating a building environment, said fireplace structure comprising:

a firebox having enclosing side walls and a top wall;

a flue having an opening in said firebox and extending upwardly from said firebox top wall;

a first damper disposed across said flue for selectively closing said flue;

an air intake duct extending from outside of said building into said firebox for providing outside air for combustion to said firebox;

means defining a heat exchange area defined about said firebox;

an air circulation duct extending from within said building environment to said heat exchange area;

an outlet means extending from said heat exchange area to said building environment for exhausting heated air to said building environment;

a damper flap disposed across said air circulation duct, said damper flap being positioned to move in response to air circulation through said duct;

a control damper disposed across said air intake duct for controlling the supply of combustion air to said firebox; and means controlling the movement of said control damper in response to the movement of said damper flap for increasing the supply of air to said firebox when air circulation is sensed through said air circulation duct by said damper flap.

5. A fireplace structure for use in heating a building environment, said fireplace structure including a firebox defined by enclosing rear, top and opposite sidewalls and having an open front wall portion removably closable by door means shiftably supported relative to said firebox for movement between open and closed positions, jacket means defining a heat exchange area about and enclosing a major portion of the exterior of said firebox, said heat exchange area including remote circulation air inlet and air outlet means opening thereinto and outwardly therefrom and adapted to be connected in series within a forced air circulation system under the control of a thermostat, combustion draft air inlet means opening into a lower portion of the interior of said firebox from the exterior of said fireplace structure, a first upper flue opening outwardly of an upper portion of the interior of said firebox to the exterior of said fireplace structure, a second lower flue opening outwardly of a lower rear portion of the interior of said firebox below said upper flue, said upper and lower flues each including flue passage portions extending through said heat exchange area, each of said first and second flues including a variable damper means operatively communicated there, at least one of said circulation air inlet and outlet means including pressure differential, openable and normally closed damper means operatively associated therewith and said combustion draft inlet means including variable damper means operatively associated therewith under the control of said air circulation damper means for opening and closing said combustion draft damper means responsive to opening and closing of said air circulation damper means.

6. The combination of claim 5 wherein said door means includes transparent door means.

7. The combination of claim 5 wherein said jacket means includes an upper front wall portion extending upwardly above said firebox and defining the forward extremity of an upper portion of said heat exchange area disposed above said firebox, said upper front wall portion having a forwardly outwardly opening heated air outlet opening formed therein.

8. The combination of claim 7 wherein said first upper flue includes an upstanding portion thereof extending upwardly through the upper portion of said heat exchange area and said second lower flue includes an upstanding portion of greater vertical extent than said first flue upstanding portion, extending upwardly through said heat exchange area.

9. The combination of claim 8 wherein said variable damper means are operably associated with upper portions of said upstanding flue portions.

* * * * *